United States Patent [19]

Havemann et al.

[11] Patent Number: 4,960,088

[45] Date of Patent: Oct. 2, 1990

[54] LOW FUEL SHUT-OFF SYSTEM

[75] Inventors: Robert K. Havemann; Herman H. Viegas, both of Bloomington; Ricardo S. DeGrego, Northfield, all of Minn.

[73] Assignee: Thermo King Corporation, Minneapolis, Minn.

[21] Appl. No.: 404,394

[22] Filed: Sep. 8, 1989

[51] Int. Cl.[5] ..... F02B 77/00

[52] U.S. Cl. ..... 123/198 D; 123/198 DB; 123/509

[58] Field of Search ..... 123/198 DB, 509, 514, 123/516, 198 D; 137/412, 571, 576

[56] References Cited

U.S. PATENT DOCUMENTS 4,411,239 10/1983 Kelch ..... 123/516

4,602,605 7/1986 Adkins ..... 123/198 D 4,776,315 10/1988 Greiner ..... 123/509

*Primary Examiner*—Noah P. Kamen

*Attorney, Agent, or Firm*—D. R. Lackey

[57] ABSTRACT

A low fuel shut-off system for a Diesel engine which includes a fuel supply circuit comprising a main fuel tank, a transfer pump, a filter array, an injection pump, injection nozzles, and an auxiliary fuel tank in the fuel circuit between the transfer pump and the injection pump. A level sensor in the auxiliary fuel tank provides a signal when the fuel level drops below a predetermined point, with the signal being used by associated electrical control to shut down the engine while a supply of fuel still remains in the fuel supply circuit between the auxiliary tank and the injection pump, and in the auxiliary tank, which is sufficient to start the engine without priming.

10 Claims, 4 Drawing Sheets

LOW FUEL SHUT-OFF SYSTEM

BACKGROUND OF THE INVENTION

1. Field of the Invention:

The invention relates in general to internal combustion engines, and more specifically to a system for preventing air from entering the injection system of a fuel injected Diesel engine due to low fuel.

2. Description of the Prior Art:

When a Diesel engine runs out of fuel, air enters the fuel injection system and the engine cannot be restarted without a time consuming priming process. In most cases the operator must seek help from a service station. The delay in restarting a Diesel engine which stopped due to lack of fuel may be especially detrimental when the engine is operating a refrigerant compressor of a transport refrigeration unit associated with a truck or trailer. The load being conditioned by the transport refrigeration unit may be a perishable load which is easily damaged if the proper temperature is not continuously maintained.

Thus, it would be desirable, and it is an object of the present invention, to provide a low fuel shut-off system for a Diesel engine which is easy to install on new equipment, and easy to retro-fit on existing equipment, which prevents air from entering the injection system due to low fuel.

SUMMARY OF THE INVENTION

Briefly, the present invention is a new and improved low fuel shut-off system for a Diesel engine having a fuel supply circuit which includes a main fuel tank, a transfer pump, a filter array, an injection pump, injection nozzles, and an auxiliary fuel supply or tank disposed between the transfer pump and the injection pump. The auxiliary fuel tank includes a sensor which monitors the level of fuel in the auxiliary fuel tank and provides a signal when the level drops below a predetermined normal level. The signal initiates a control function which shuts down the engine, while maintaining fuel in the fuel supply circuit between the auxiliary fuel tank and the injection pump, and a sufficient supply of fuel in the auxiliary tank to enable re-starting of the engine without allowing air to enter the injection system. A warning light on an operator's control console is also energized which informs the operator of the low fuel condition.

In a first embodiment of the invention, the auxiliary fuel tank is located between the filter array and the injection pump, while in a second and preferred embodiment of the invention the auxiliary fuel tank is located between the transfer pump and the filter array. The latter embodiment is preferred because the transfer pump does not have to pump against the pressure drop through the fuel filters, enabling the transfer pump to fill the auxiliary tank more readily. Also, upon a low fuel shut down, the fuel filters will be full of fuel in the second embodiment, unlike the first embodiment where the filter manifold runs dry before the level of fuel in the auxiliary tank starts to drop.

BRIEF DESCRIPTION OF THE DRAWINGS

The invention may be better understood and further advantages and uses thereof more readily apparent when considered in view of the following detailed description of exemplary embodiments, taken with the accompanying drawing, in which.

DESCRIPTION OF PREFERRED EMBODIMENTS

Figure 1:
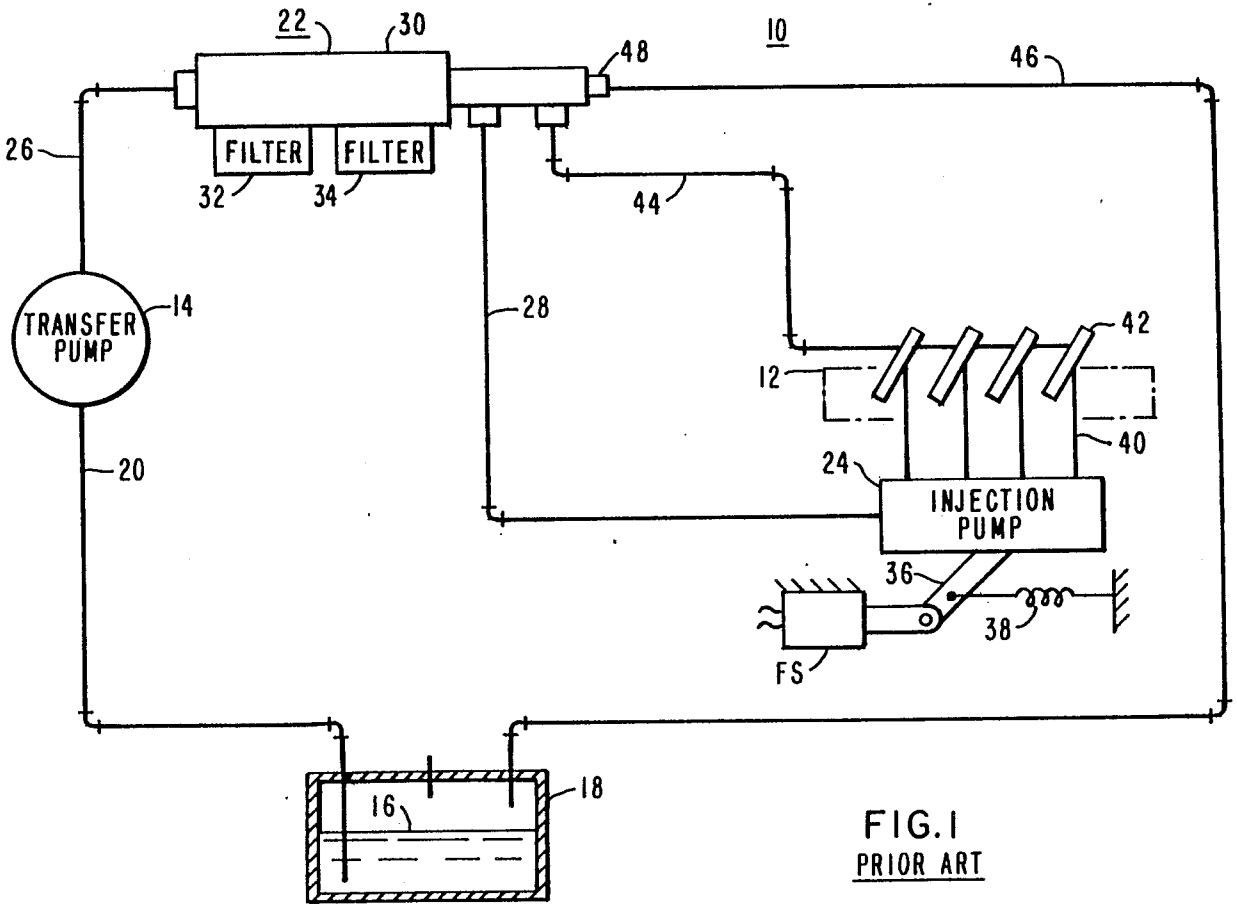
FIG. 1 PRIOR ART
FIG. 1 is schematic diagram of a typical prior art fuel supply system for a fuel injected internal combustion Diesel engine.

Referring now to the drawing and to FIG. 1 in particular, there is shown a fuel supply circuit arrangement 10 for a Diesel engine 12. A transfer pump 14 draws fuel 16 from a vented main fuel tank 18 via a fuel line 20 through a pre-filter (not shown), and then pushes it through a fuel filter array 22 to an injection pump 24 via fuel lines 26 and 28. The filter array 22 includes a fuel filter manifold 30 and primary and secondary filters 32 and 34. The injection pump 24 includes a fuel lever 36 which is biased "off" by a spring 38. A fuel solenoid FS, when energized, overcomes the bias to actuate fuel lever 36 to an "on" position, which allows injection pump 24 to supply fuel to injection lines 40, which in turn are connected to injection nozzles 42. A fuel return line 44 connects nozzles 42 to the filter manifold 30, and a fuel return line 46, which also functions as an air bleed line, interconnects a fuel overflow valve 48 associated with filter manifold 30 back to the main fuel tank 18. The injection pump 24 raises the fuel pressure and meters fuel to the injection nozzles 42 at the correct time, and the nozzles 42 then lift to allow fuel to enter the cylinders.

The present invention provides a reserve column of fuel in the fuel supply circuit 10, between the transfer pump and the injection pump, which has many advantages, including the elimination of electrical wiring back to the main fuel tank 18. In a transport refrigeration application, the main fuel tank 18 may be 15 to 20 feet away from the engine which drives the refrigerant compressor.

Figure 2:
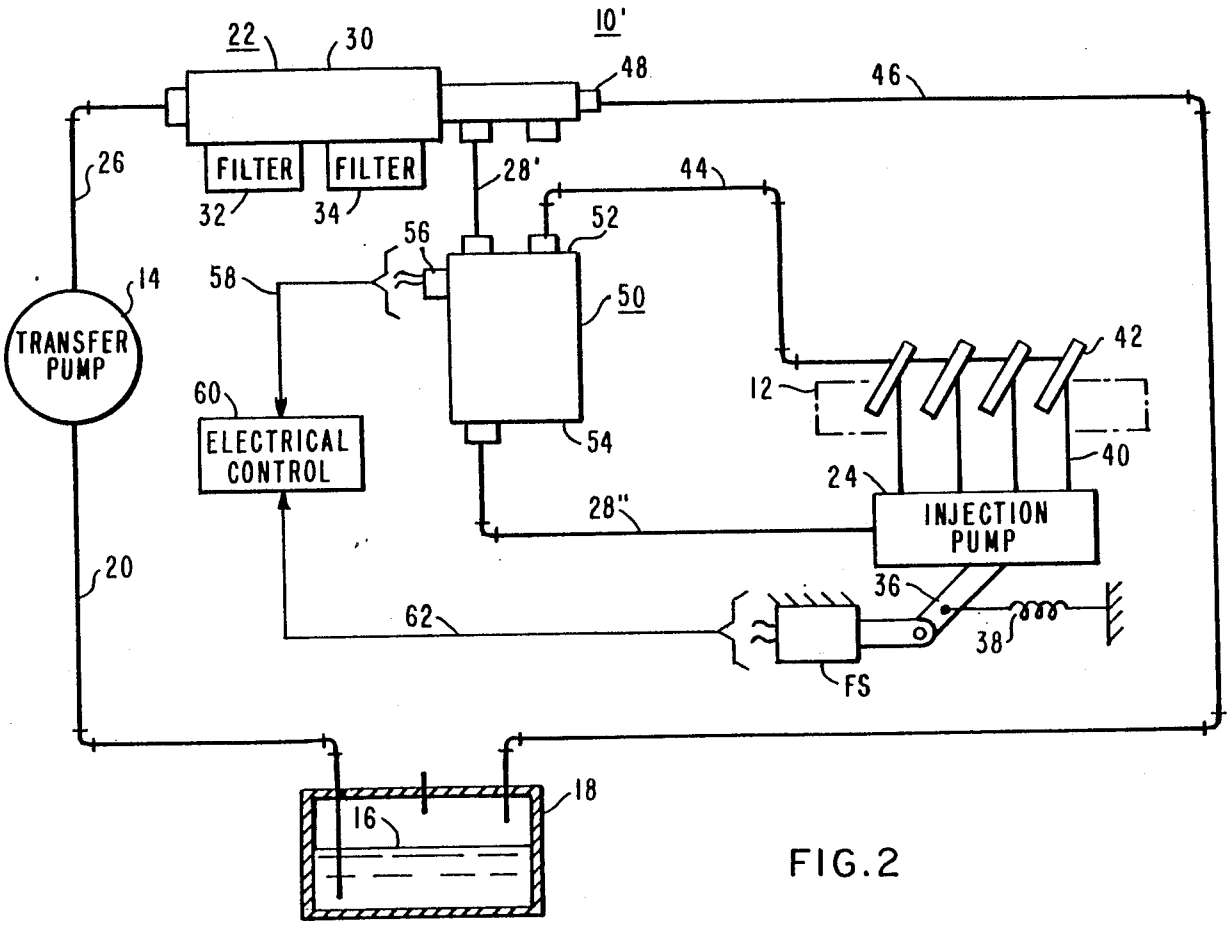
FIG. 2 is a schematic diagram of a fuel supply system for a Diesel engine constructed according to a first embodiment of the invention.

In a first embodiment of the invention, shown in FIG. 2, there is shown a fuel supply circuit arrangement 10' in which the reserve column of fuel is in the form of a vented auxiliary fuel tank 50 disposed between the output of filter array 22 and the input of injection pump 24. Tank 50 is located such that fuel therein will enter injection pump 24 by gravity flow. Thus, fuel line 28 of the FIG. 1 arrangement may be cut to provide first and second sections 28' and 28'', which sections are connected to auxiliary fuel tank 50. Items in FIG. 2 which may be the same as in FIG. 1 are identified with the same reference numerals, and will not be described again.

In a preferred embodiment of auxiliary fuel tank 50, the fuel tank 50 is an elongated structure, with the longitudinal axis thereof being vertically oriented to provide an upper fuel entry end 52 and a lower fuel discharge end 54. Fuel line 28' from the output of filter array 22 is connected to the upper end 52, and fuel line 28'', which leads to injection pump 24, is connected to the lower end 54.

As illustrated, the return fuel line 44 from nozzles 42 may be connected to the inlet end 52 of auxiliary fuel tank 50, instead of to the filter array 22. Bleed fuel from the injectors is returned to the auxiliary tank 50, rather than to the main fuel tank 18, because this return fuel will help to stretch out the available reserve fuel. Under low ambient conditions it takes longer to draw or lift fuel from the main tank, and it thus requires more reserve fuel to keep the engine running. Using the bleed fuel avoids the need for a larger reserve tank.

A sensor 56, which may be liquid level sensor, a pressure switch detects system pressure at tank 50 and detects when the fuel level starts to fall, a thermistor switch, or any other type of level sensing device, is disposed near the upper end 52 of auxiliary tank 50, to monitor the level of fuel in auxiliary tank 50. When the level of fuel in tank 50 drops below a predetermined level which is normally maintained when there is an adequate supply of fuel, sensor 56 provides some sort of signal, such as a contact closure. Electrical leads 58 convey the condition of sensor 56 to electrical control 60 which shuts engine 12 down by deenergizing fuel solenoid FS, which is electrically connected to control 60 via electrical leads 62. The auxiliary tank 50 should be sized such that there is about a 10 minute supply of fuel remaining in tank 50 when electrical control 60 shuts engine 12 down.

Figure 3:
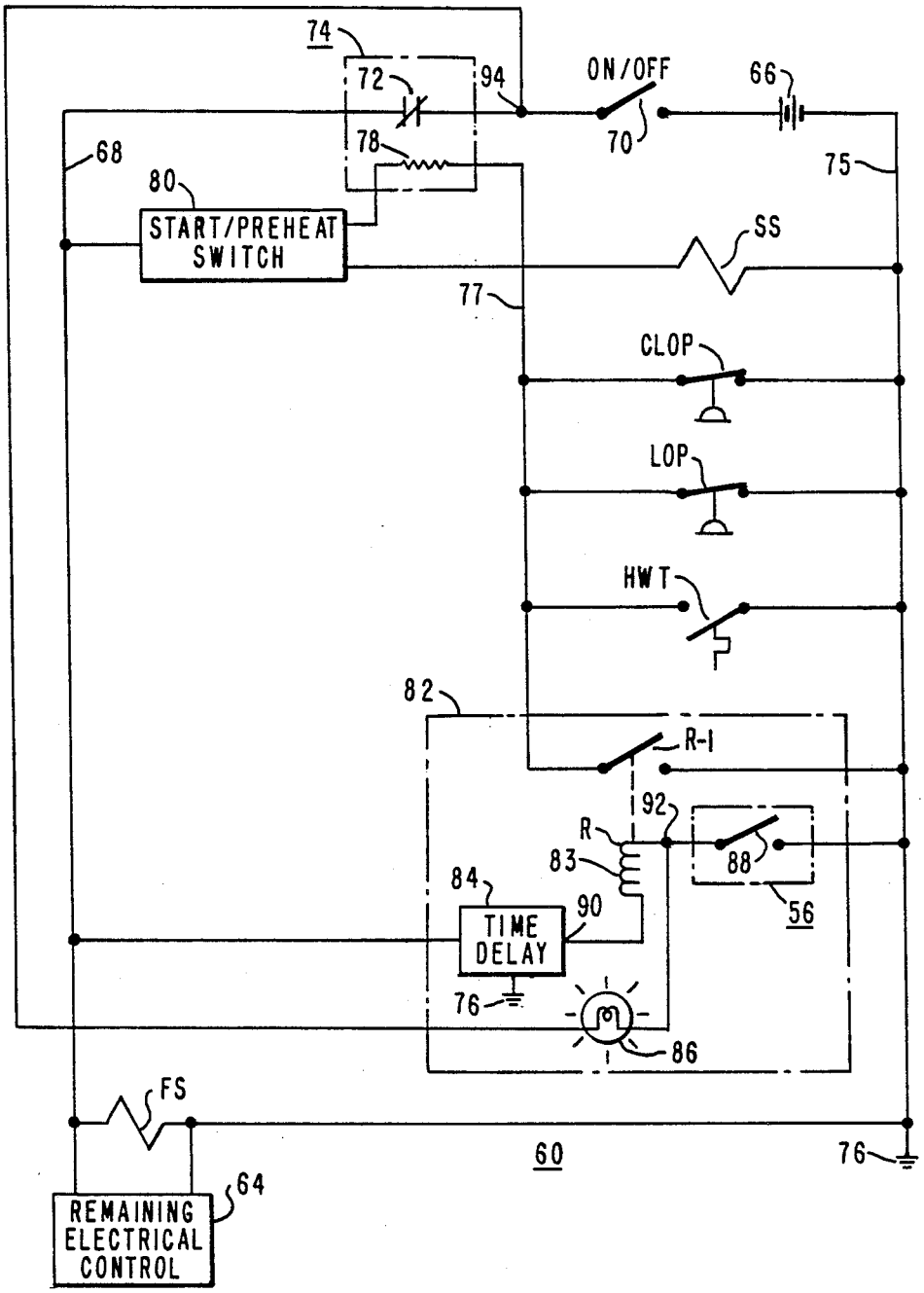
FIG. 3 is an electrical schematic diagram illustrating a control arrangement constructed according to the teachings of the invention.

Electrical control 60 which functions according to the teachings of the invention is shown in FIG. 3. FIG. 3 is a schematic diagram of a pertinent portion of electrical control associated with a transport refrigeration unit, modified according the invention. Only the portion of control 60 required to understand the invention is set forth in FIG. 3. U.S. Pat. No. 4,419,866, which is assigned to the same assignee as the present application, shows and describes the remaining portion of control 60 which is shown generally in block 64, and U.S. Pat. No. 4,419,866 is hereby incorporated into the specification of the present application by reference.

One side of a source 66 of unidirectional potential, such as a battery and alternator, is connected to an electrical supply conductor 68 via an on/off switch 70 and a normally closed contact 72 of a reset switch 74. The remaining side of source 66 is connected to a conductor 75 which is connected to chassis ground 76. The fuel solenoid FS shown in FIGS. 1, 2 and 4, may be connected between conductors 68 and 75.

Reset switch 74 may be a thermal type of manual reset switch which includes a resistor 78. Resistor 78 has one side connected to conductor 68 via a start/-preheat switch 80. During the time that switch 80 is manually actuated to energize a starter solenoid SS, resistor 78 is disconnected from conductor 68. Once engine 12 starts and switch 80 released, resistor 78 is connected to conductor 68. The remaining side of resistor 78 is connected to a plurality of parallel connected protective devices or sensors via a conductor 77, such as a low compressor oil pressure switch CLOP, a low engine oil pressure switch LOP, and an engine coolant temperature switch HWT. Switches CLOP and LOP close on low oil pressure, and switch HWT closes upon excessive coolant temperature. Should any protective sensor close its associated switch during the operation of engine 12, resistor 78 is energized and it starts to heat. After about 30 to 60 seconds the heat melts a soldered shaft inside a tube (not shown) allowing the switch to trip and open its contacts 72, shutting down the associated transport refrigeration unit, including engine 12 via the fuel solenoid FS, which will be de-energized. Switch 74 must be manually reset after the solder cools.

The modification of control 60 according to the invention is shown within broken outline 82. The modification 82 includes a relay R having an electromagnetic coil 83 and a set of normally open contacts R-1, a time delay device 84, a low fuel warning light 86, and a set of normally open contacts 88 associated with the hereinbefore mentioned fuel level sensor 56.

The time delay device 84 is connected from conductor 68 to chassis ground 76 and it starts timing each time it is energized, connecting a terminal 90 to conductor 68 after a predetermined period of time, such as five minutes, for example. Terminal 90 is connected to coil 83 of relay R and contacts 88, which are serially connected from terminal 90 to conductor 75.

The set of contacts R-1 of relay R is connected from conductor 77 to conductor 75, in parallel with the hereinbefore described protective devices.

The warning light 86 is connected from the junction 92 between serially connected coil 83 and contacts 88, to the junction 94 between on/off switch 70 and contacts 72 of reset switch 74.

In the operation of control 60, when engine 12 is started after a normal shut-down, the time delay 84 will enable the liquid level sensor 56 to become effective after a five minute delay. The purpose of the time delay 84 is for an engine restart after a low fuel shutdown, and has no useful function upon a normal start up. If the main fuel tank 18 runs low and transfer pump 14 can no longer maintain the predetermined normal level of fuel in auxiliary tank 50, sensor 56 will detect that the desired fuel level is not being maintained and it will close its contacts 88. Warning light 86, located on an operator's control console, will be immediately energized, indicating the low fuel condition, and coil 83 of relay R will be energized, closing contacts R-1. Resistor 78 of reset switch 74 will start producing heat, and 30 to 60 seconds later, contacts 72 of reset switch 74 will open, deenergizing conductor 68 and shutting engine 12 down via the now de-energized fuel solenoid FS. A ten minute supply of fuel, for example, remains in auxiliary tank 50, as well as fuel in line 28'' between the output end 54 of tank 50 and the injection pump 24. The warning light 86 will remain in the energized state until the operator opens the on/off switch 70.

After the operator adds fuel to the main fuel tank 18, reset switch 74 is manually reset, and if switch 70 had been moved to the "off" position, it is now set to the "on" position. Time delay 84 will be energized, and the operator has five minutes to start the enqine. Five minutes was selected as a reasonable time for enabling the transfer pump 14 to fill the filter array 22 and auxiliary fuel tank 54 to its normal level. If the fuel in tank 50 is returned to the normal level before the end of the five minute timing period, contacts 88 of sensor 56 will have opened, and the closing of contacts within time delay 84 at the end of five minutes will have no effect. If the operator is unable to start engine 12 within the five minute period, relay R will become energized when the time delay times out, and 30 to 60 seconds later the system will be shut down again. Since a five minute supply of fuel will still remain in auxiliary tank 50, the operator has one more chance to start the engine after the reset switch 74 cools and is manually reset. If the engine cannot be started within the second five minute period, a major fault is present in the intake side of the system which requires service. Thus, providing a larger auxiliary fuel tank 50 for enabling additional starting attempts would be of no benefit.

While the arrangement of FIG. 2 functions properly in most ambients, and most high and low speed engine re-starting modes, it has been found that placing the auxiliary tank 50 between the transfer pump 14 and the filter array 22, instead of between the filter array 22 and the injection pump 24 as shown in FIG. 2, greatly facilitates re-starting of engine 12 after a low fuel shut-down, ie., the time to refill the auxiliary tank 50 is reduced. This embodiment of the invention, which is the preferred embodiment, is set forth in FIG. 4, which is a schematic diagram of a fuel supply circuit arrangement 10''.

More specifically, auxiliary fuel tank 50' has its inlet end 52 connected to the output of transfer pump 14 via fuel line 26', and the discharge end 54 of auxiliary tank 50 is connected to the input of filter array 22 via fuel line 26''. For proper operation, it has been found that the outlet end 54 should be physically located above the inlet of filter array 22, as indicated by double-headed arrow 96. The main reason for this is after a low-fuel shut down, fuel in tank 50' will be free to flow to filter array 22 by gravity. It is also necessary that an air vent 98 on tank 50' be at the highest location of any vent in the system, with any other system vents being returned to this same "high" location. If vents of different elevations were to be used, the system would drain down to the location of the lowest vent when the system is shut down. This elevated location also adds additional static head to the reserve fuel column in tank 50'.

Bleeding of trapped air upon re-starting, and maintaining system pressure at the auxiliary tank 50' is facilitated by providing the hereinbefore mentioned vent orifice 98 in tank 50' and connecting orifice 98, which may be about a 0.030 inch orifice, for example, to the main fuel tank 18 via an air bleed and fuel return line 100. A vent and fuel return orifice in the outlet of the filter array 22, such as the hereinbefore mentioned overflow valve 48, may also be connected to air bleed line 100, at its highest point, via a line 102 and a check valve 104, to maintain system pressure in the fuel filter-to-injector circuit. Since any fuel in air bleed line 100 from orifice 98 in tank 50' would be unfiltered, check valve 104 prevents this unfiltered fuel from making its way to the injection pump 24 via lines 102 and 28.

Figure 4:
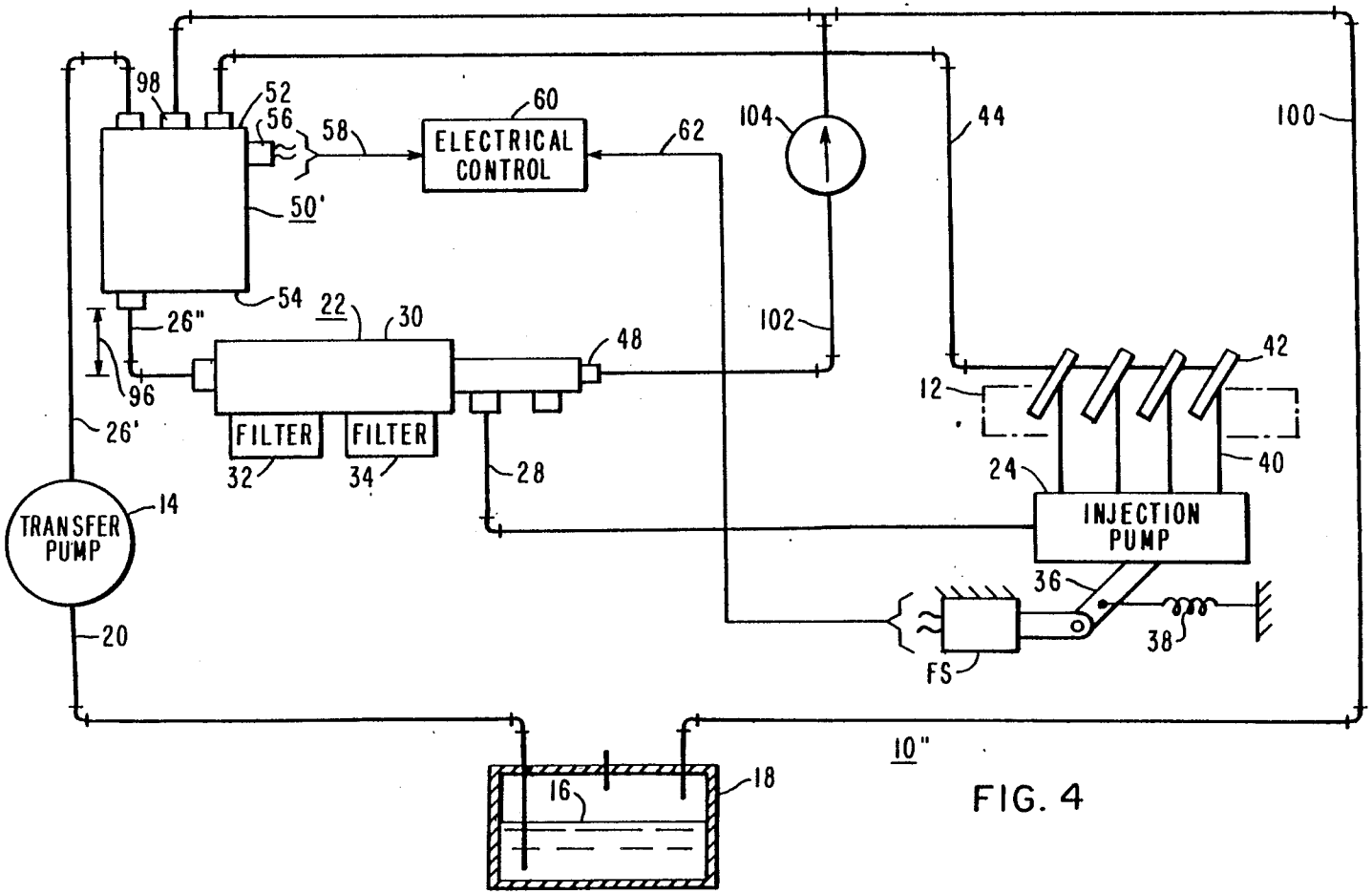
FIG. 4 is a schematic diagram of a fuel supply system for a Diesel engine constructed according to a second embodiment of the invention.

A major advantage of the FIG. 4 embodiment over the FIG. 2 embodiment is the fact that transfer pump 14 can re-fill tank 50' without having to pump against the pressure drop of the filter array 22. This is especially useful when the engine is started at a relatively high speed, as fuel is used up more rapidly during a high speed engine start up, and also at low ambient temperatures where Diesel fuel is viscous, which requires a longer time to bring fuel up from the fuel tank. Also, upon a low fuel shut-down, the fuel filter array 22 will still be full of fuel, unlike the FIG. 2 embodiment in which the fuel filter manifold 30 runs dry before the level in the auxiliary tank 50 starts to drop.

In summary, there has been shown new and improved low fuel start-up systems for a Diesel engine which are self contained within the engine package, eliminating field wiring between the engine package and a remotely located fuel tank. The system retains fuel for re-starting in an auxiliary or reserve tank 50, and from the tank 50 to the injection pump, making it unnecessary to prime the injection pump after a low fuel shut down.

We claim:

1. In a low fuel shut-off system for a Diesel engine having a fuel supply circuit which includes a main fuel tank, a transfer pump, a filter array, an injection pump, and injection nozzles, the improvement comprising:

an auxiliary fuel tank in the fuel supply circuit, between the transfer pump and the injection pump, with the transfer pump maintaining fuel in said auxiliary fuel tank above a predetermined level during normal operation, sensor means providing a signal when the level of fuel in said auxiliary fuel tank drops below said predetermined level, indicating the transfer pump is nc longer providing sufficient fuel to said auxiliary fuel tank, and electrical control means responsive to the signal provided by said sensor means for stopping the engine before depletion of the fuel in said auxiliary tank while maintaining fuel in the fuel supply circuit between said auxiliary tank and the injection pump, enabling re-starting of the engine without priming, said control means including time delay means actuated upon start-up of the engine which prevents the signal provided by the sensor means from stopping the engine for a predetermined period of time.

2. In the low fuel shut-off system of claim 1, wherein the auxiliary fuel tank is located in the fuel circuit between the filter array and the injection pump.

3. In the low fuel shut-off system of claim 2, a fuel return line from the injection nozzles to the auxiliary fuel tank.

4. In the low fuel shut-off system of claim 1 wherein the auxiliary fuel tank is located in the fuel circuit between the transfer pump and the filter array.

5. In the low fuel shut-off system of claim 4, a fuel return line from the injection nozzles to the auxiliary fuel tank.

6. In the low fuel shut-off system of claim 4 wherein the auxiliary fuel tank and filter array respectively include an outlet and an inlet, with the outlet of the auxiliary fuel tank being physically disposed above the inlet to the filter array.

7. In the low fuel shut-off system of claim 4 including a vent orifice in the auxiliary fuel tank, and an air bleed line between the vent orifice and the main fuel tank.

8. In the low fuel shut-off system of claim 1 wherein the injection pump includes a fuel lever having on and off positions, with said control means stopping the engine in response to the signal provided by the sensor means by actuating said fuel lever to the off position.

9. In a low fuel shut-off system for a Diesel engine having a fuel supply circuit which includes a main fuel tank, a transfer pump, a filter array, an injection pump, and injection nozzles, the improvement comprising:

an auxiliary fuel tank in the fuel supply circuit, between the transfer pump and the filter array, with the transfer pump maintaining fuel in said auxiliary fuel tank above a predetermined level during normal operation, sensor means providing a signal when the level of fuel in said auxiliary fuel tank drops below said predetermined level, indicating the transfer pump is no longer providing sufficient fuel to said auxiliary fuel tank, and electrical control means responsive to the signal provided by said sensor means for stopping the engine before depletion of the fuel in said auxiliary tank while maintaining fuel in the fuel supply circuit between said auxiliary tank and the injection pump, enabling re-starting of the engine without priming, a vent orifice in the auxiliary fuel tank, an air bleed line between the vent orifice and the main fuel tank, said filter array including a manifold having an input and an output, a vent orifice in the output of the manifold connected to the highest elevation point of the air bleed line, and a check valve in the air bleed line disposed to prevent fuel flow towards the orifice in the manifold.

10. In a low fuel shut-off system for a Diesel engine having a fuel supply circuit which includes a main fuel tank, a transfer pump, a filter array, an injection pump, and injection nozzles, the improvement comprising:

an auxiliary fuel tank in the fuel supply circuit, between the transfer pump and the filter array, with the transfer pump maintaining fuel in said auxiliary fuel tank above a predetermined level during normal operation.

sensor means providing a signal when the level of fuel in said auxiliary fuel tank drops below said predetermined level, indicating the transfer pump is no longer providing sufficient fuel to said auxiliary fuel tank, and electrical control means responsive to the signal provided by said sensor means for stopping the engine before depletion of the fuel in said auxiliary tank while maintaining fuel in the fuel supply circuit between said auxiliary tank and the injection pump, enabling re-starting of the engine without priming, a vent orifice in the auxiliary fuel tank, an air bleed line between the vent orifice and the main fuel tank, a vent orifice in the filter array connected to the highest elevation point of the air bleed line, and a check valve disposed to prevent fuel flow in the air bleed line towards the orifice in the filter array.

* * * * *